US005851721A

United States Patent [19]

Shibata

[11] Patent Number: 5,851,721

[45] Date of Patent: Dec. 22, 1998

[54] PHOTOTHERMOGRAPHIC ELEMENTS

[75] Inventor: Takeshi Shibata, Kanagawa, Japan

[73] Assignee: Fuji Photo Film Co., Ltd., Kanagawa, Japan

[21] Appl. No.: 887,419

[22] Filed: Jul. 2, 1997

[30] Foreign Application Priority Data

Jul. 9, 1996 [JP] Japan ..... 8-179701

[51] Int. Cl.[6] ..... G03C 8/52; G03C 1/795

[52] U.S. Cl. ..... 430/203; 430/212; 430/227; 430/533

[58] Field of Search ..... 430/533, 203, 430/212, 227

[56] References Cited

U.S. PATENT DOCUMENTS

| | | | |
|---|---|---|---|
| 3,579,609 | 5/1971 | Sevenich | 260/873 |
| 4,187,113 | 2/1980 | Mathews et al. | 430/533 |
| 4,483,914 | 11/1984 | Naito et al. | 430/203 |
| 4,500,626 | 2/1985 | Naito et al. | 430/203 |
| 4,503,137 | 3/1985 | Sawada | 430/203 |
| 4,559,920 | 12/1985 | Toncelli et al. | 125/17 |
| 5,432,043 | 7/1995 | Hayashi | 430/533 |
| 5,585,231 | 12/1996 | Yamada et al. | 430/203 |

FOREIGN PATENT DOCUMENTS

| | | | |
|---|---|---|---|
| 4-157464 | 5/1992 | Japan | G03C 8/40 |

*Primary Examiner*—Richard L. Schilling
*Attorney, Agent, or Firm*—Sughrue, Mion, Zinn, Macpeak & Seas, PLLC

[57] ABSTRACT

A film formed by stretching and heat-fixing a melt of a polyester and a polyolefin which has a melting temperature lower than that of the polyester is employed as a support for a diffusive transfer-type photothermographic material, which prevents processing unevenness and white spot.

5 Claims, No Drawings

PHOTOTHERMOGRAPHIC ELEMENTS

FIELD OF THE INVENTION

The present invention relates to a photographic element which is used for a system forming an image by heating a light-sensitive silver halide, a binder, and a base and/or a base precursor together with a small amount of water.

BACKGROUND OF THE INVENTION

Photothermographic materials are known in this technological field, and materials and processes thereof are described, for example, in *Bases of Photographic Engineering* (Chapter: Nonsilver Photography), Coronasha, 1982, pp. 242–255.

Many processes are proposed to obtain color images by heat development. For example, processes of forming color images by linking the oxidation products of developing agents to couplers are proposed by U.S. Pat. Nos. 3,531,286, 3,761,270 and 4,021,240, Belgian Patent 802,519, *Research Disclosure* (Hereinafter abbreviated as "RD"), September, 1975, pp. 31–32, and so forth.

However, when exposed to strong light or stored over a long period of time, the above-mentioned of nonfixing-type photothermographic materials have a serious problem of gradually developing color on a white background, because silver halides are left in the materials after formation of the color images. Further, the above-mentioned processes have the disadvantages of taking a relatively long time for processing and of forming only the images with high fog and low image density in general.

As a process for overcoming these disadvantages, it is proposed to form or release diffusive dyes in an image pattern by heating and then transfer the diffusive dyes to an image-receiving material containing mordants with the aid of a solvent such as water (U.S. Pat. Nos. 4,500,626, 4,483,914, 4,503,137, and 4,559,920, JP-A-59-165054 (The term "JP-A" as used herein means an "unexamined published Japanese patent application"), and the like)

In this process, however, the light-sensitive materials require still high development temperatures, and do not necessarily exhibit sufficient stability to aging. In JP-A-59-218443, JP-A-61-238056, published European patent application 210,660A2, etc., it is therefore disclosed that promotion of development, lowering in development temperature and simplification of process are achieved by performing heat development and transfer of dyes in the presence of a base or a base precursor and a trace amount of water.

In addition, many processes are proposed to form positive color images by heat development. For example, U.S. Pat. No. 4,559,290 proposes a system containing oxidized-form compounds having no color image-releasing ability derived from the so-called DRR compounds and a reducing agent or a precursor thereof, in which the reducing agent is oxidized on heat development, depending on exposure amount of silver halides, and the oxidized-form compounds are reduced with the reducing agent which was not oxidized, so as to release diffusive dyes. Further, as the compounds releasing diffusive dyes according to a similar mechanism, published European patent application 220,746A and *JIII Journal of Technical Disclosure,* 87–6199, Vol. 12 (22) describe photothermographic materials using compounds which release diffusive dyes by reductive cleavage of an N—X bond (X represents an oxygen atom, a nitrogen atom, or a sulfur atom).

The photothermographic materials can be developed with small and compact devices, because the materials can be readily and rapidly processed, compared with conventional wet development light-sensitive materials. Therefore, relatively inexpensive devices have been developed and commercially available as color copies or color printers using silver salt color light-sensitive material systems. Various improvements are required to enlarge the use of these devices and one of the improvements is to decrease wastes from the photothermographic materials. The photothermographic material solved the problem of waste liquid from the processing solutions used for the conventional wet development light-sensitive materials. However, image forming processes of a separation-type diffusion transfer system has a new problem that waste are formed. Improvement for reducing the waste from the photothermographic materials is strongly demanded in view of the protection of global environment (resource saving and reduction in industrial wastes).

As described in JP-A-4-157464, the use of paper as a support for the photothermographic materials offers the advantages of low cost and easy waste disposal (used light-sensitive materials) as compared with use of polymer films such as polyethylene terephthalate film. In recent photothermographic materials, paper laminated with polyethylene or the like (WP paper) is used widely as a support. However, the support becomes thick due to the structure, which is unfavorable in view of reduction in the industrial wastes. On the other hand, formation of thin WP paper introduces a problem of generating elliptical unevenness in processing density with sizes of a few mm to a few cm and circular white spots with sizes of about 0.2 mm to 2 mm. Further, these problems become particularly serious when heating parts for heat development are designed to be plane for compact processing machines.

SUMMARY OF THE INVENTION

An object of the present invention is to provide a diffusion transfer-type photothermographic material which uses a support generating no unevenness in processing density and white spot, and particularly, relates to a color photothermographic material using such a support.

The object of the present invention was achieved by a diffusive transfer-type photothermographic material which comprises (i) a light-sensitive element comprising a light-sensitive silver halide and a binder provided on a first support and (ii) an image-fixing element provided on a second support, wherein said light-sensitive element and said image-fixing element are capable of forming an image by being attached to each other with a small amount of water under heat in the presence of a base, a base precursor or a mixture thereof, after or simultaneous imagewise exposure of said light-sensitive element, wherein at least one of the first support and the second support is a film which comprises a stretched and heat-fixed melt comprising a polyester and a polyolefin having a melting temperature lower than that of the polyester.

The present invention is described below in detail.

DETAILED DESCRIPTION OF THE INVENTION

The supports of the present invention are prepared by stretching and heat-fixing particular melt. The melt comprise a polyester and a polyolefin which has a melting temperature lower than that of the polyester. The melt may further contains an elastic polymer. Furthermore, other components may be added to the mixtures, as needed.

The polyesters can be prepared, for example, by polycondensation of dibasic acids and diols.

Examples of the dibasic acids include terephthalic acid, isophthalic acid, isophthalic acids containing a sulfonic acid group, adipic acid, phthalic acid, 2,5-, 2,6-, and 2,7-naphthalenedicarboxylic acids, succinic acid, sebacic acid, azelaic acid, diphenyldicarboxylic acid, and hexahydroterephthalic acid. These dibasic acids can be used singly or as a mixture of two or more kinds thereof. Of these acids, terephthalic acid, isophthalic acid, naphthalene dicarboxylic acids are preferred, and terephthalic acid is particularly preferred. A mixture of terephthalic acid and isophthalic acid (ratio: 9:1 to 2:8 by weight), a mixture of terephthalic acid and a naphthalenedicarboxylic acid (ratio: 9:1 to 2:8 by weight), and the like are preferably employed.

Examples of the diols for preparation of the polyesters include ethylene glycol, triethylene glycol, neopentyl glycol, polyethylene glycol, ethylene oxide adducts of bisphenol A (2,2-bis(4-(2-hydroxyethoxy)phenyl)propane), diethylene glycol, 1,3-propanediol, 1,4-butanediol, and 1,4-cyclohexanedimethanol. These diols may be used singly or as a mixture of two or more kinds thereof. Of these diols, ethylene glycol, 1,4-butanediol and the like are preferred.

The polyesters to be used are not particularly limited, and they can be appropriately selected depending on the object. Examples of the polyester include polyethylene terephthalate (PET), polybutylene terephthalate (PBT), polyethylene naphthalates (PEN), polyethylene isophthalate, and the like. These polyesters may be used singly or as a mixture of two or more kinds thereof. In the present invention, polyethylene terephthalate (PET) is preferred in view of stretchability, or it is preferred to contain at least polyethylene terephthalate. The polyesters may be appropriately synthesized or commercially available polyesters may be used.

The weight average molecular weight of the polyesters is preferably from 20,000 to 80,000, and more preferably from 30,000 to 50,000. The molecular weight failing to fall in these ranges may lack extrudability.

The polyesters preferably have a glass transition point (Tg) of 0° C. to 150° C., and more preferably 40° C. to 120° C.

The polyolefins described above are not particularly limited, as long as they have a melting temperature lower than that of the polyesters used together, and they can be appropriately selected depending on the object. Olefin homopolymers and olefin copolymers including polyethylene, polypropylene, polybutene, and poly(4-methyl-1-pentene) may be exemplified. These polyolefins may be used singly or as a mixture of two or more kinds thereof. Of these polyolefins, polypropylene is preferred in the present invention. The polyolefins to be used may be appropriately synthesized or commercially available polyolefins may be used.

Of the above-mentioned polyolefins, for example, the melting temperature of polypropylene is 165° C. to 176° C., and that of polybutene is 126° C. to 128° C.

The combination of the above-mentioned polyolefins and the above-mentioned polyesters can be appropriately determined depending on the object. For example, a combination of polypropylene and polyethylene terephthalate is desirable in view of stretching conditions.

The content of the polyolefins is preferably from 0.5 to 20% by weight, and more preferably from 1 to 15% by weight, based on the weight of the above-described melt. Further, the following numerical ranges are also preferred as the polyolefin content. That is, the ranges wherein either of the lower limits in the numerical ranges of the above-mentioned content or either of the numerical values of the contents in examples described later is made a lower limit and either of the numerical values of the contents in examples described later is made an upper limit; and the ranges wherein either of the upper limits in the numerical ranges of the above-mentioned content or either of the numerical values of the contents in examples described later is made an upper limit and either of the numerical values of the contents in examples described later is made a lower limit.

The polyolefin content less than 0.5% by weight may results in a decrease in the amount of foam, whereas the polyolefin content exceeding 20% by weight often causes an excess amount of foam. The content falling in the above-mentioned ranges is free from such a disadvantage and, in addition, produces an advantageous effect in cushioning properties of the resulting films.

The above-mentioned elastic polymers are those themselves have elasticity and can give elasticity to mixtures of these polymers with the above-mentioned polyesters. Examples of the elastic polymers include rubber, thermoplastic elastomers, and soft polymers.

Examples of the rubber include natural rubber (NR), isoprene rubber (IR), butadiene rubber (BR), 1,2-polybutadiene rubber (1,2-BR), styrene-butadiene rubber (SBR), chloroprene rubber (CR), nitrile rubber (NBR), butyl rubber (IIR), ethylene-propylene rubber (EPM), chlorosulfonated polyethylene (CSM), acrylic rubber (ACM), epichlorohydrin rubber (CO), polysulfide rubber (T), silicone rubber (Q), fluororubber (FKM), and urethane rubber (U).

Examples of the thermoplastic elastomers include olefin-type thermoplastic elastomers (TPO), urethane-type thermoplastic elastomers (TPU), polyester-type thermoplastic elastomers (TPEE), polyamide-type thermoplastic elastomers (TPAE), 1,2-polybutadiene-type thermoplastic elastomers, vinyl chloride-type thermoplastic elastomers (TPVC), and fluorine-type thermoplastic elastomers.

The soft polymers described above include ABS resins and soft vinyl chloride resins.

In the present invention, the elastic polymers include copolymers of the above-mentioned polyester moieties and these elastic polymer moieties as well.

These elastic polymers can be used singly or as a mixture of two or more kinds thereof. Of these elastic polymers, the polyester-type thermoplastic elastomers are preferred, because of satisfactory compatibility with the polyesters.

The content of the elastic polymers is preferably from 0 to 50% by weight, and more preferably from 3 to 20% by weight, based on the weight of the mixture of the above-described polyester and the above-mentioned elastic polymer. The content exceeding 50% by weight may result in deterioration in stiffness of supports. The content falling in these ranges is free from such a disadvantage and, in addition, can improve cushioning properties of the supports for thermal transfer recording.

The content of the polyesters is preferably from 50 to 99.5% by weight, and more preferably from 80 to 97% by weight, based on the weight of the melt of the polyester and the polyolefins or the melt of the polyesters, the polyolefins, and the elastic polymers. Further, the following numerical ranges are also preferred as the content of the polyesters. That is, the ranges wherein either of the lower limits in the numerical ranges of the above-mentioned content or either of numerical values of the contents in examples described later is made a lower limit and either of numeral values of the contents in examples described later is made an upper limit; and the ranges wherein either of the upper limits in the numerical ranges of the above-mentioned content or either of the numerical values of the contents in examples described later is made an upper limit and either of numerical values of the contents in examples described later is made a lower limit.

The content less than 50% by weight may result in insufficient stiffness of the supports. On the other hand, the content falling in the above-mentioned ranges is free from such a disadvantage and, in addition, produces an advantageous effect in cushioning properties of the supports for thermal transfer recording.

Components other than the above-mentioned ones can be employed without particular limitation, and appropriately selected and employed, depending on the use or the object of the supports for thermal transfer recording. They are, for example, white fine particles, light resistance improvers, additives, and so forth.

Examples of the white fine particles include barium sulfate, titanium oxide, calcium carbonate, calcium sulfate, zinc oxide, silica, kaolin, talc, clay, diatomaceous earth, magnesium silicate, and calcium silicate. They can be used singly or as a mixture of two or more kinds thereof. Of these white fine particles, barium sulfate, titanium oxide, and calcium carbonate are preferred in view of improvement in whiteness of the supports for thermal transfer recording, and it is preferred to use at least one of them. These particles may be appropriately synthesized or commercially available white fine particles may be used. The use of the white fine particles efficiently prevents the supports from becoming transparent.

The average size of the white fine particles is preferably from 0.01 to 5 $\mu$m, and more preferably from 0.1 to 3 $\mu$m.

The content of the white fine particles is preferably from 0 to 30% by weight, and more preferably from 0 to 20% by weight, based on the above-mentioned melt. The content exceeding 20% by weight may result in insufficient smoothness. On the other hand, the content falling in the above-mentioned ranges restrains is free from such a disadvantage and, in addition, produces an advantageous effect in whiteness and opacifying power of the resulting supports.

Examples of the light resistance improvers include zinc sulfate, zinc oxide, hindered amine-type antioxidants, and benzotriazole-type ultraviolet-absorbing agents such as bensophenone. The improvers may be used singly or as a mixture of two or more kinds thereof.

The additives described above are, for example, dyes, fluorescent brightening agents and stabilizers. They may be used singly or as a mixture of two or more kinds thereof.

In order to obtain the above-mentioned melt, the polyester or the mixture of the polyester and the elastic polymer, the polyolefin, and the above-mentioned other components used as needed are mixed according to known procedures and, for example, melted and extruded at 280° C. to 330° C. and then cooled and solidified at 20° C. to 110° C. Although these components are usually supplied as pellets for mixing, they may be provided in powder or liquid form, respectively.

The melting and extruding can be carried out by the use of known extruders, film-forming dies, etc. The cooling and solidifying can be carried out by the use of known rotating drums, cooling rolls, etc. In general, amorphous sheets are obtained from the melts. In the present invention, the melts are subjected to stretching and heat-fixing.

Although the stretching is not particularly limited, biaxial stretching is preferred. It is desirable to stretch two to five times in the lengthwise direction (in the lengthwise direction) and two to five times in the crosswise direction (in the width direction), at 80° C. to 160° C.

The diaxial stretching temperature less than 80° C. may result in breaking of bases, whereas the temperature exceeding 160° C. may cause the decrease in degree of orientation. On the other hand, the temperature falling in the range is free from such disadvantages. The draw ratio less than two times in the lengthwise direction and in the crosswise direction, respectively, may result in insufficient orientation, or in insufficient strength, whereas the draw ratio exceeding five times may cause excessively large foams derived from the polyolefins, resulting in deterioration in surface conditions. On the other hand, the draw ratio falling in the range as given above is free from such disadvantages.

The heat-fixing is preferably carried out at 165° C. to 290° C., and particularly preferably at 190° C. to 245° C. The temperature less than 165° C. may prevent the polyolefins from melting to leave spherical particles thereof, which causes the deteriorated surface conditions of bases, whereas the temperature exceeding 290° C. may disturb formation of film, because of melting of the polyesters themselves. On the other hand, the temperature falling in the ranges as given above is free from such disadvantages and, in addition, produces an advantageous effect in improvement in thermal stability.

The supports of the present invention have excellent cushioning properties, because of the internal structure thereof as described below. That is, since the polyester are inferior in compatibility with the polyolefin, the melt is in a state where a large number of spherical islands of the polyolefins exit in matrix of the polyester. When such melts are stretched, voids are produced at the interfaces between the polyesters and the polyolefins, because of their incompatibility. Thereafter, membranes of the polyolefins are formed around the spherical voids by heat-fixing at a temperature higher than the melting temperatures of the polyolefins. As a result, the inner structure in which a large number of foams exit in matrix of the polyesters is retained. Therefore, the supports of the present invention have excellent cushioning characteristics due to a large number of foams derived from the polyesters.

In the present invention, the thickness of the supports is preferably from 10 to 500 $\mu$m, and particularly preferably from 20 to 300 $\mu$m. The thickness less than 10 $\mu$m may result in jamming, whereas the thickness exceeding 500 $\mu$m delays rise in temperature on heat development, causing image density to decrease.

The opacity of the supports of the present invention can be represented by "total light transmittance" which can be measured according to ASTM test method D-1003-61. The total light transmittance is preferably from 20% or less, and particularly preferably from 10% or less.

In the present invention, the average roughness, $R_a$, of surfaces of the supports is preferably 0.50 $\mu$m or less,and more preferably from 0.01 to 0.3 $\mu$m. The average roughness exceeding 0.50 $\mu$m may result in unsatisfactory transfer of images. On the other hand, the average roughness falling in the ranges as given above is free from such a disadvantage and, in addition, provides the supports having sufficiently smooth surfaces. Use of such supports for thermal transfer recording makes it possible to prepare image-receiving paper having excellent surface evenness.

In the present invention, the apparent specific gravity of the supports is preferably from 0.9 to 1.3, and more preferably from 0.95 to 1.25. Further, the following numerical ranges are also preferred as the apparent specific gravity. That is, the ranges wherein either of the lower limits in the numerical ranges of the apparent specific gravity as given above or either of numerical values of the apparent specific gravity in examples described later is made a lower limit and either of numerical values of the apparent specific gravity in examples described later is made an upper limit; and the ranges wherein either of the upper limits in the numerical ranges of the apparent specific gravity as given above or either of numerical values of the apparent specific gravity in examples described later is made an upper limit and either of numerical values of the apparent specific gravity in examples described later is made a lower limit.

The apparent specific gravity less than 0.9 may causes blemishes to readily develop, whereas exceeding 1.3 often results in insufficient cushioning properties of the resulting supports. On the other hand, the apparent specific gravity falling in the ranges as given above is free from such a disadvantage.

In the present invention, the numerical values of the apparent specific gravity of the supports for the thermal transfer recording are lower than those of the polyesters contained therein. This is due to the fact that the supports of the present invention have the inner structure in which a large number of foams derived from the polyolefins are contained in the polyesters which are a constituent component of the supports as described above.

The light-sensitive element used in the present invention basically contain a light-sensitive silver halide emulsion and a binder, and can contain, as needed, an organic metallic salt oxidizing agent, a dye-providing compound (Some reducing agents may concurrently serve as the dye-providing compound in some times as described later), and so forth.

Although these components are incorporated into a single layer in many cases, they can be separately added to several layers. For example, if a colored dye-providing compound is placed in a layer lower than a silver halide emulsion layer, a decrease in sensitivity of the light-sensitive element can be prevented. Although a reducing agent is preferably incorporated into the light-sensitive element, the reducing agent may be supplied from the outside of the element, for example, by diffusing it from an image-fixing element described later to the light-sensitive element.

In order to obtain a wide variety of colors in the chromocyte diagram by the use of three primary colors of yellow, magenta and cyan, at least three silver halide emulsion layers having sensitivity in spectral regions different from one another are used in combination. For example, there are a combination of three layers of a blue sensitive layer, a green sensitive layer, and a red sensitive layer, a combination of a green sensitive layer, a red sensitive layer, and an infrared sensitive layer, a combination of a red sensitive layer, an infrared sensitive layer (I), and an infrared sensitive layer (II), and so forth as described in JP-A-59-180550, JP-A-64-13546, JP-A-62-253159, published European patent application 479,167, etc. The respective light-sensitive layers can be arranged according to various orders known for the conventional color light-sensitive materials. Further, the respective layers may be separated into two or more layers, as needed, as described in JP-A-1-252954.

In the light-sensitive element, various light-insensitive layers such as a protective layer, a undercoat layer, an interlayer, a yellow filter layer, and an antihalation layer may be provided between the above-mentioned silver halide emulsion layers, or as a top layer or a bottom layer, and various auxiliary layers such as a backing layer can be formed on the opposite side of the support. Example of such layers provided include layer structures as described in the above-mentioned specifications, an undercoat layer as described in U.S. Pat. No. 5,051,335, an interlayer containing a solid pigment as described in JP-A-1-167838 and JP-A-61-20943, an interlayer containing a reducing agent or a DIR compound as described in JP-A-1-120553, JP-A-5-34884 and JP-A-2-64634, an interlayer containing an electron carrier as described in U.S. Pat. Nos. 5,017,454 and 5,139,919 and JP-A-2-235044, a protective layer containing a reducing agent as described in JP-A-4-249245, or combinations of these layers.

The supports are preferably designed so as to have a antistatic function and a surface resistivity of 1012 Ω·cm or less.

Silver halide emulsions usable in the present invention include silver chloride, silver bromide, silver iodobromide, silver chlorobromide, silver chloroiodide, and silver chloroiodobromide. However, the content of silver chloride in at least one silver halide emulsion is 50 mol % or more.

The silver halide emulsions used in the present invention may be of a surface latent image-type or an internal latent image-type. The internal latent image-type emulsion can be used as a direct reversal emulsion by combining with a nucleating agent or a light reversal agent. Further, the so-called core shell emulsion in which the inside and the surface layer of a grain have phases different from each other may also be used, or silver halides having a different composition may be joined by epitaxial junction. The silver halide emulsions may be monodisperse or polydisperse and, it is preferably used to mix monodisperse emulsions to control gradation as described in JP-A-1-167743 and JP-A-4-223463. The grain size of silver halides is preferably from 0.1 to 2 μm, and particularly preferably from 0.2 to 1.5 μm. Crystal habits of silver halide grains may be either of regular crystal form such as cubes, tetrahedrons and tetradecahedrons; irregular crystal form such as spheres and plates with high aspect ratios; crystal form having crystal defects such as a twin plane; and complex form of these crystal habits.

The silver halide emulsions used in the present invention include all silver halide emulsions prepared according to procedures as described in U.S. Pat. Nos. 4,500,626 (column 50) and 4,628,021; *Research Disclosure* (hereinafter abbreviated as "RD"), 17,029 (1978), RD 17,643 (December, 1978, pp. 22–23), RD 18,716 (November, 1979, p. 648), and RD 307,105 (November, 1989, pp. 863–865); JP-A-62-253159; JP-A-64-13546; JP-A-2-236546; JP-A-3-110555; P. *Glafkides, Chemie et Phisique Photographique*, Paul Montel, 1967; G. F. Duffin, *Photographic Emulsion Chemistry*, Focal Press, 1966; V. L. Zelikman, et al., *Making and Coating Photographic Emulsion*, Focal Press, 1964; etc.

In the present invention, the so-called salt removal to remove excess salts is preferably carried out in the course of preparing the light-sensitive silver halide emulsions. Means of the removal include a method of water washing with noodle in which gelled gelatin is used and a sedimentation method utilizing inorganic salts containing polyvalent anions (for example, sodium sulfate), anionic surfactants, anionic polymers (for example, sodium polystyrenesulfonate), or gelatin derivatives (for example, aliphatic acylated gelatin, aromatic acylated gelatin, aromatic carbamoylated gelatin, etc.). The sedimentation method is preferably used.

For various purposes, compounds of heavy metals such as iridium, rhodium, platinum, cadmium, zinc, thallium, lead, iron, and osmium may be incorporated into the light-sensitive silver halide emulsions used in the present invention. These compounds may be used singly or in combination of two or more kinds thereof. Although the amount thereof depends on the object, it is from about 10–9 to 10–3 mole per mole of silver halides, in general. The metals may be uniformly incorporated into the silver halide grains, or may be localized in the inside or on the surface of the grains.

Emulsions described in JP-A-2-236542, JP-A-1-116637, JP-A-5-181246, etc. are preferably employed for this purpose.

In the present invention, rhodanide salts, ammonia, tetrasubstituted thioether compounds, organic thioether derivatives described in JP-B-47-11386 (The term "JP-B" as used herein means an "examined Japanese patent publication"), or sulfur-containing compounds described in JP-A-53-144319, and so forth can be employed as solvents of silver halides in a grain-forming step of the light-sensitive silver halide emulsions.

For other conditions, refer to P. *Glafkides, Chemie et Phisigue Photographigue*, Paul Montel, 1967; G. F. Duffin, *Photographic Emulsion Chemistry*, Focal Press, 1966; V. L. Zelikman, et al., *Making and Coating Photographic Emulsion*, Focal Press, 1964; etc. That is, all of the acidic method, the neutral method and the ammonia method can be used, and all of the one side mixing method, the simultaneous mixing method and a combination thereof can be utilized for reaction of soluble silver salts with soluble halide salts. In order to obtain a monodisperse emulsion, the simultaneous mixing method is preferably employed.

The reverse mixing method can also be employed, which form silver halide grains under excess silver ions. The so-called controlled double jet method, a type of the simultaneous mixing method, can also be used, in which pAg is kept constant in the liquid phase on forming silver halides.

The concentrations of silver salts and halide salts added, the amounts thereof, and the addition speeds thereof may be increased to accelerate the growth of silver halide grains (JP-A-55-142329, JP-A-55-158124, and U.S. Pat. No. 3,650,757).

All of known methods can be used for stirring the reaction mixtures. Further, the temperature and pH of the reaction mixtures in the formation of the silver halide grains can be set without any particular limitation, depending on the object. The pH preferably ranges from 2.2 to 8.5, and more preferably from 2.5 to 7.5.

Light-sensitive silver halide emulsions are usually subjected to chemical sensitization. For the chemical sensitization of the light-sensitive silver halide emulsions of the present invention, chalcogen sensitization such as sulfur sensitization, selenium sensitization and tellurium sensitization; noble metal sensitization using gold, platinum, or palladium; and reductive sensitization, which are known for emulsions for the conventional light-sensitive materials, can be employed singly or in combination (for example, JP-A-3-110555 and JP-A-5-241267). These chemical sensitizations can also be carried out in the presence of nitrogen-containing heterocyclic compounds (JP-A-62-253159). Anti-fogging agents listed later can be further added to the emulsions after completing the chemical sensitization. Concretely, procedures described in JP-A-5-45833 and JP-A-62-40446 can be employed for this purpose.

In the chemical sensitization, the pH preferably ranges from 5.3 to 10.5, and more preferably from 5.5 to 8.5, and the pAg preferably ranges from 6.0 to 10.5, and more preferably from 6.8 to 9.0.

The coating amount of the light-sensitive silver halide emulsions used in the present invention ranges from 1 $mg/m^2$ to 10 $g/m^2$ in terms of silver.

The light-sensitive silver halide emulsions used in the present invention are subjected to spectral sensitization for which methine dyes etc. are used, in order to give color sensitivity to green, red and infrared rays to the silver halides. Further, the blue sensitive emulsions may be subjected to spectral sensitization in the blue region, as needed.

The dyes used include cyanine dyes, merocyanine dyes, complex cyanine dyes, complex merocyanine dyes, holopolar cyanine dyes, hemicyanine dyes, styryl dyes, and hemioxonol dyes. Concretely, sensitizing dyes described in U.S. Pat. No. 4,617,257, JP-A-59-180550, JP-A-64-13546, JP-A-5-45828, JP-A-5-45834, etc. can be employed.

These sensitizing dyes can be employed singly or in combination. The combinations of the dyes are frequently employed for supersensitization or the adjustment of wavelength for spectral sensitivity.

Compounds exhibiting the supersensitization, which themselves do not act as dyes for spectral sensitization or do not substantially absorb visible light, may be incorporated into the emulsions together with the sensitizing dyes (for example, the dyes described in U.S. Pat. No. 3,615,641, JP-A-63-23145, etc.).

Addition of these sensitizing dyes to the emulsions may be performed on, before, or after chemical ripening, or may be performed before or after the nucleation of silver halide grains according to procedures described in U.S. Pat. Nos. 4,183,756 and 4,225,666. These sensitizing dyes or supersensitizing agents may be added to the emulsions as a solution of an organic solvent such as methanol, as a gelatin dispersion, or as a surfactant solution. The amount thereof is from about $10^{-8}$ to $10^{-2}$ mole per mole of silver halides, in general.

Additives used for these processes and known photographic additives usable for the light-sensitive element and the image-fixing element of the present invention are described in the above-mentioned RD 17643, RD 18716 and RD 307105, and the corresponding portions are shown in the following table.

| Additives | RD 17643 | RD 18716 | RD 307105 |
|---|---|---|---|
| 1. Chemical Sensitizers | page 23 | page 648, right column | page 866 |
| 2. Sensitivity Increasing Agents | | page 648 right column | |
| 3. Spectral Sensitizers, Supersensitizing Agents | page 23–24 | page 648, right column to page 649, right column | page 866–868 |
| 4. Fluorescent Brighteners | page 24 | page 648, right column | page 868 |
| 5. Antifogging Agent, Stabilizers | page 24–25 | page 649, right column | page 868–870 |
| 6. Light Absorbers, Filter Dyes, UV Absorbers | page 25–26 | page 649, right column to page 650, left column | page 873 |
| 7. Dye Image Stabilizers | page 25 | page 650, left column | page 872 |
| 8. Hardeners | page 26 | page 651, left column | page 874–875 |
| 9. Binders | page 26 | page 651, left column | page 873–874 |
| 10. Plasticizers Lubricants | page 27 | page 650, right column | page 876 |
| 11. Coating Aids Surfactants | page 26–27 | page 650, right column | page 875–876 |

-continued

| Additives | RD 17643 | RD 18716 | RD 307105 |
|---|---|---|---|
| 12. Antistatic Agents | page 27 | page 650, right column | page 876–877 |
| 13. Matting Agents | | | page 878–879 |

Binders for layers constituting the light-sensitive element and the image-fixing element are preferably hydrophilic. Examples thereof include those described in the above-mentioned *Research Disclosure* and JP-A-64-13546 (page 71–75). Concretely, transparent or translucent, hydrophilic binders are preferred, and examples thereof include natural compounds such as protein (for example, gelatin and its derivatives) and polysaccharides (for example, cellulose derivatives, starch, gum arabic, dextran, and pullulan); and synthetic polymeric compounds such as polyvinyl alcohol, polyvinyl pyrrolidone, and acrylamide polymers. Highly water-absorptive polymers, that is, homopolymers prepared from vinyl monomers containing a —COOM or —$SO_3M$ group (M represents a hydrogen atom or an alkali metal) or copolymers prepared from these vinyl monomers or from these monomers and other vinyl monomers (for example, sodium methacrylate, ammonium methacrylate and Sumikagel L-5H manufactured by Sumitomo Chemical Co., Ltd.) can also be employed as the binders. These binders can also be employed in combination of two or more kinds thereof. Particularly, combinations of gelatin with the above-mentioned binders are preferred.

Further, gelatin can be selected from lime-treated gelatin, acid-treated gelatin, and so-called ash-removed gelatin in which the contents of calcium, etc. are reduced, depending on the object. Combinations of these gelatins are also preferably employed.

In a system in which heat development is carried out with the aid of a trace amount of water supplied, use of such highly water-absorptive polymers makes it possible to rapidly absorb the water. Further, use of the highly water-absorptive polymers for dye-fixing layers or the protective layers thereof can prevent dyes transferred to the dye-fixing layers from being transferred again to other things.

In the present invention, the coating amount of the binders is preferably 20 g/$m^2$ or less, more preferably 10 g/$m^2$ or less, and most preferably from 0.5 to 7 g/$m^2$.

In the present invention, organic metal salts can be used as oxidizing agents together with light-sensitive silver halide emulsions. Of the organic metal salts, organic silver salts are particularly preferred.

Organic compounds usable for forming the organic silver salts include benzotriazoles described in U.S. Pat. No. 4,500,626 (columns 52 and 53), fatty acids and other compounds. Silver acetylide described in U.S. Pat. No. 4,775,613 also is useful. The organic silver salts can also be employed as a mixture of two or more kinds thereof.

The amount of these organic silver salts employed together with the light-sensitive silver halides is from 0.01 to 10 moles, and preferably from 0.01 to 1 mole, per mole of the silver halides. The total coating amount of the light-sensitive silver halide emulsions and the organic silver salts is from 0.05 to 10 g/$m^2$, and preferably from 0.1 to 4 g/$m^2$ in terms of silver.

The reducing agents used in the present invention include those known for the field of light-sensitive elements. Dye-providing compounds having a reducing power as described later are also included in the reducing agents (In this case, other reducing agents can be simultaneously used). Further, precursors for reducing agents can also be employed, which themselves do not have reductivity but develop the reductivity by the action of nucleophilic reagents or heat in the course of development.

Examples of the reducing agents and the precursors thereof used in the present invention are described in U.S. Pat. Nos. 4,500,626 (column 49–50), 4,839,272, 4,330,617, 4,590,152, 5,017,454 and 5,139,919, JP-A-60-140335 (page 17–18), JP-A-57-40245, JP-A-56-138736, JP-A-59-178458, JP-A-59-53831, JP-A-59-182449, JP-A-59-182450, JP-A-60-119555, JP-A-60-128436, JP-A-60-128439, JP-A-60-198540, JP-A-60-181742, JP-A-61-259253, JP-A-62-201434, JP-A-62-244044, JP-A-62-131253, JP-A-62-131256, JP-A-63-10151, JP-A-64-13546 (page 40–57), JP-A-1-120553, JP-A-2-32338, JP-A-2-35451, JP-A-2-234158, JP-A-3-160443, published European patent application 220,746 (page 78–96), etc. Various reducing agents as disclosed in U.S. Pat. No. 3,039,869 can also be employed in combination.

When nondiffusive reducing agents are employed, electron carriers and/or precursors thereof can be employed in combination, as needed, in order to promote electron transfer between the nondiffusive reducing agents and developable silver halides. The electron carriers and the precursors thereof which are most preferably employed in the present invention include those described in the above-mentioned U.S. Pat. No. 5,139,919, published European patent application 418,743, JP-A-1-138556, and JP-A-3-102345. Further, procedures of stably introducing the electron carriers and the precursors thereof into layers as described in JP-A-2-230143 and JP-A-2-235044 can be preferably employed.

The electron carriers and the precursors thereof can be selected among the reducing agents and the precursors thereof as described above. It is desirable that the electron carriers and the precursors thereof have larger mobility than the nondiffusive reducing agents (electron donors). Particularly useful electron carriers are 1-phenyl-3-pyrazolidones and aminophenols.

The nondiffusive reducing agents used in combination with the electron carriers are those which do not substantially move in the layers of light-sensitive materials, among the above-mentioned reducing agents. Preferred examples thereof include hydroquinones, sulfonamidophenols, sulfonamidonaphthols, compounds described as electron donors in JP-A-53-110827, U.S. Pat. Nos. 5,032,487, 5,026,634 and 4,839,272, and nondiffusive dye-providing compounds having reducing power as described later.

Further, the electron donor precursors as described in JP-A-3-160443 also can be preferably employed.

Furthermore, the above-mentioned reducing agents can also be employed for interlayers and protective layers for various purposes such as color mixture prevention, improvement in color reproduction, improvement in a white background, and prevention of silver transfer to the image-fixing element. Concretely, reducing agents described in published European patent applications 524,649 and 357,040, JP-A-4-249245, JP-A-2-64633, JP-A-2-46450, and JP-A-63-186240 are preferably employed. Development inhibitor-releasing reductive compounds as described in JP-B-3-63733, JP-A-1-150135, JP-A-2-110557, JP-A-2-64634, JP-A-3-43735, and published European patent application 451,833 can also be employed.

In the present invention, the total amount of the reducing agents are preferably from 0.01 to 20 moles, and particularly preferably from 0.1 to 10 moles per 1 mole of silver.

In the present invention, silver can be employed as an image-forming substance. Further, the so-called dye-providing compounds which form or release movable dyes corresponding or adversely corresponding to the reaction in which silver ion is reduced to silver under a high temperature can also be employed.

The first example of the dye-providing compounds usable in the present invention is compounds (couplers) forming dyes by an oxidative coupling reaction. The couplers may be four equivalent couplers or two equivalent couplers. Two equivalent couplers which contain nondiffusive groups as releasing groups and form diffusive dyes by the oxidative coupling reaction are also preferred. The nondiffusive groups may form polymer chains. Examples of the color-developing agents and the couplers are described in detail in T. H. James, *The Theory of the Photographic Process*, the fourth edition, pp. 291–334 and pp. 354–361, RD 307,105 (p. 871), JP-A-58-123533, JP-A-58-149046, JP-A-58-149047, JP-A-59-111148, JP-A-59-124399, JP-A-59-174835, JP-A-59-231539, JP-A-59-231540, JP-A-60-2950, JP-A-60-2951, JP-A-60-14242, JP-A-60-23474, JP-A-60-66249, etc.

Other examples of the dye-providing compounds include compounds which have a function of releasing or diffusing diffusive dyes in an image pattern. The compounds of this type can represent the following general formula [L1]:

$$((\text{Dye})_m\text{—Y})_n\text{—Z} \qquad [L1]$$

wherein Dye represents a dye group, a dye group temporally shifted to shorter wave length, or a dye precursor group; Y represents a mere bond or a linking group; Z represents a group having the property of producing a difference in diffusivity of a compound represented by $((\text{Dye})_m\text{—Y})_n\text{—Z}$ corresponding or adversely corresponding to light-sensitive silver salts having latent images in an image pattern or the property of producing a difference in diffusivity between $(\text{Dye})_m\text{—Y}$ released and $((\text{Dye})_m\text{—Y})_n\text{—Z}$; m represents an integer of from 1 to 5; n represents 1 or 2; and when any one of m and n is not 1, (Dye)'s may be the same or different.

Examples of the dye-providing compounds represented by general formula [L1] include compounds shown by the following items (1) to (5). The compounds of items (1) to (3) form diffusive dye images (positive dye images) adversely corresponding to the development of silver halides, whereas the compounds of items (4) and (5) form diffusive dye images (negative dye images) corresponding to the development of silver halides.

(1) Dye developers of hydroquinone-type developers and dye components linked thereto as described in U.S. Pat. Nos. 3,134,764, 3,362,819, 3,597,200, 3,544,545 and 3,482,972, JP-B-3-68387, etc. may be used. Although the dye developers are diffusive in an alkaline condition, they become nondiffusive by reacting with silver halides.

(2) Nondiffusive compounds which release diffusive dyes in an alkaline condition and lose the releasing capability by the reaction with silver halides may be used. Examples thereof include compounds which release diffusive dyes by an intramolecular nucleophilic displacement reaction as described in U.S. Pat. No. 3,980,479, etc.; and compounds releasing diffusive dyes by an intramolecular rewinding reaction of an isoxazolone ring as described in U.S. Pat. No. 4,199,354, etc.

(3) Nondiffusive compounds which release diffusive dyes by the reaction with reducing agents which remain unoxidized in development as described in U.S. Pat. No. 4,559,290, published European patent application 220,746A2, U.S. Pat. No. 4,783,396, *Journal of Technical Disclosure,* 87–6199, JP-A-64-13546, etc. may be used.

Examples thereof include compounds which release diffusive dyes by an intramolecular nucleophilic displacement reaction after undergoing reduction as described in U.S. Pat. Nos. 4,139,389 and 4,139,379, JP-A-59-185333, JP-A-57-84453, etc.; compounds which release diffusive dyes by an intramolecular electron transfer reaction after undergoing reduction as described in U.S. Pat. No. 4,232,107, JP-A-59-101649, JP-A-61-88257, RD 24025 (1984), etc.; compounds which release diffusive dyes by cleavage of a single bond after undergoing reduction as described in published West Germany patent application 3,008,588A, JP-A-56-142530, U.S. Pat. Nos. 4,343,893 and 4,619,884, etc.; nitro compounds which release diffusive dyes after accepting electrons as described in U.S. Pat. No. 4,450,223, etc.; and compounds which release diffusive dyes after accepting electrons as described in U.S. Pat. No. 4,609,610, etc.

Further, preferred examples thereof include compounds containing an N—X bond (X represents an oxygen atom, an sulfur atom, or a nitrogen atom) in and an electron-attracting group in a molecule as described in published European patent application 220,746, *Journal of Technical Disclosure,* 87–6199, U.S. Pat. No. 4,783,396, JP-A-63-201653, JP-A-63-201654, JP-A-64-13546, etc.; compounds containing an $SO_2$—X group (X has the same meanings as above) and an electron-attracting group in molecule as described in JP-A-1-26842; compounds containing a PO—X bond (X has the same meanings as above) and an electron-attracting group in a molecule as described in JP-A-63-271344; and compounds containing a C—X' bond (X' has the same meanings as X or represents —$SO_2$—) and an electron-attracting group in a molecule as described in JP-A-63-271341. Further, compounds releasing diffusive dyes by cleavage of a single bond after undergoing reduction by a π-bond conjugated with an electron-accepting group as described in JP-A-1-161237 and JP-A-1-161342 can also be utilized.

Of these compounds, the compounds containing an N—X bond and an electron-attracting group in a molecule are preferred. Examples thereof include compounds (1) to (3), (7) to (10), (12), (13), (15), (23) to (26), (31), (32), (35), (36), (40), (41), (44), (53) to (59), (64), and (70) described in published European patent application 220,746 and U.S. Pat. No. 4,783,396; compounds (11) to (23) described in *Journal of Technical Disclosure,* 87–6199; and compounds (1) to (84) described in JP-A-64-13546.

(4) Couplers which contain diffusive dyes as releasing groups and release diffusive dyes by reaction with oxidation products from reducing agents (DDR couplers) may also used. Examples thereof are described in British Patent 1,330,524, JP-B-48-39165, U.S. Pat. Nos. 3,443,940, 4,474,867 and 4,483,914, etc.

(5) Compounds which have capability to reduce silver halides or organic silver salts and release diffusive dyes on reduction (DRR compounds). These compounds are preferable since they do not require use of other reducing agents and, therefore, do not have an disadvantage of staining images with oxidation products from the reducing agents. Typical examples thereof are described in U.S. Pat. Nos. 3,928,312, 4,053,312, 4,055,428 and 4,336,322, JP-A-59-65839, JP-A-5969839, JP-A-53-3819, JP-A-51-104343, RD 17465, U.S. Pat. Nos. 3,725,062, 3,728,113 and 3,443,939, JP-A-58-116537, JP-A-57-179840, U.S. Pat. No. 4,500,626, etc. Preferred examples of the DRR compounds are compounds described in columns 22 to 44) of the above-mentioned U.S. Pat. No. 4,500,626, particularly the compounds (1) to (3), (10) to (13), (16) to (19), (28) to (30), (33)

to (35), (38) to (40), and (42) to (64). Further, compounds described in columns 37 to 39 of U.S. Pat. No. 4,639,408 are also useful.

Besides the above-mentioned couplers and the dye-providing compounds represented by general formula [L1], dye silver compounds in which organic silver salts are linked to dyes (RD, May, 1978, pp. 54–58, etc.), azo dyes used for the heat development silver dye bleach process (U.S. Pat. No. 4,235,957, RD, April, 1976, pp. 30–32, etc.), leuco dyes (U.S. Pat. Nos. 3,985,565 and 4,022,617, etc.) can also be employed.

Hydrophobic additives such as the dye-providing compounds and the nondiffusive reducing agents can be incorporated into the layers of the light-sensitive elements according to known procedures as described in U.S. Pat. No. 2,322,027. In this case, high boiling point organic solvents as described in U.S. Pat. Nos. 4,555,470, 4,536,466, 4,536,467, 4,587,206, 4,555,476 and 4,599,296, JP-B-3-62256, etc. can be used, as needed, together with low boiling point organic solvents having boiling points of 50° C. to 160° C. The dye-providing compounds, the nondiffusive reducing agents, and the high boiling point organic solvents can also be employed as a mixture of two or more kinds thereof, respectively.

The amount of the high boiling point organic solvents is 10 g or less, preferably 5 g or less, and more preferably from 0.1 to 1 g per 1 g of the dye-providing compounds used, and 1 cc or less, preferably 0.5 cc or less, and particularly preferably 0.3 cc or less per 1 g of the binders.

A process for dispersing the hydrophobic additives by utilizing polymers as described in JP-B-51-39853 and JP-A-51-59943 and a process of adding the additives as fine particle dispersions as described in JP-A-62-30242, etc. can also be utilized.

In addition to these processes, compounds which are substantially insoluble in water can be incorporated into binders as fine particles.

Various surfactants can be employed for dispersing hydrophobic compounds into hydrophilic colloids. Surfactants listed, for example, in JP-A-59-157636 (pp. 37–38) and the above-mentioned RD's can be employed for this purpose.

Compounds for activating development and stabilizing images at the same time can be used for the light-sensitive element of the present invention. Preferred examples of such compounds are described in U.S. Pat. No. 4,500,626 ( columns 51 and 52).

In the system of forming images by the diffusion transfer of dyes, various compounds can be added to the constituent layers of the light-sensitive element of the present invention in order to fix or decolor undesired dyes or coloring matter or to improve the white backgrounds of images formed. The compounds described in published European patent application 353,741 and 461,416, JP-A-63-163345, and JP-A-62-203158 are used for these purposes.

For improvement in color differentiation and enhancement in sensitivity, various pigments and dyes can be incorporated into the constituent layers of the photosensitive element of the present invention. Compounds described in the above-mentioned RD's, and compounds and layer structures described in published European patent applications 479,167 and 502,508, JP-A-1-167838, JP-A-4-343355, JP-A-2-168252, JP-A-61-20943, published European patent applications 479,167 and 502,508, etc. can be utilized for this purpose.

In the system of forming images by the diffusion transfer of dyes, an image-fixing element is used together with a light-sensitive element. The image-fixing element may be formed on a support different from the light-sensitive element, or may be formed on the same support as the light-sensitive element. The relation of the light-sensitive material to the image-fixing element, the relation thereof to a support, and the relation thereof to a white reflection layer as described in U.S. Pat. No. 4,500,626 (column 57) can also be applied to these relations in the present invention.

The image-fixing element preferably employed in the present invention has at least one layer containing a mordant and a binder. The mordants usable herein are those known for the photographic field. Examples thereof include mordants described in U.S. Pat. No. 4,500,626 (columns 58 and 59), JP-A-61-88256 (pp. 32–41), and JP-A-1-161236 (pp. 4–7); and mordants described in U.S. Pat. Nos. 4,774,162, 4,619,883 and 4,594,308, etc. Further, dye-accepting polymeric compounds as described in U.S. Pat. No. 4,463,079 may be utilized.

In the present invention, binders used for image-fixing are preferably the above-mentioned hydrophilic binders. Further, simultaneous use of carageenans as described in published European patent application 443,529 and simultaneous use of latexes having glass transition temperatures of 40° C. or less as described in JP-B-3-74820 are preferably employed.

Auxiliary layers such as a protective layer, a separation layer, an undercoat layer, an interlayer, a backing layer, and an anticurl layer can be provided, as needed, for the image-fixing element. It is particularly useful to provide the protective layer.

Plasticizers, lubricants, and high boiling point organic solvents as improvers for separating the light-sensitive material from the image-fixing element can be incorporated into the constituent layers of the light-sensitive element and the image-fixing element. Concretely, they include those described in the above-mentioned RD's, JP-A-62-245253, etc.

Further, various silicone oils (all silicone oils including from dimethylsilicone oil to modified silicone oils in which various organic groups are introduced into dimehylsiloxane) can be used for the purpose described above. Various modified silicone oils described in Modified Silicone Oils (Technical Material P6-18B) published by Shin-Etsu Silicone Co., Ltd., particularly carboxy-modified silicone (trade name X-22-3710), are useful.

Further, silicone oils described in JP-A-62-215953 and JP-A-63-46449 are also efficient.

Discoloration preventives may be employed for the light-sensitive element and the image-fixing element. The discoloration preventives include antioxidants, ultraviolet-absorbing agents, and some kinds of metal complexes. Dye image stabilizers and ultraviolet-absorbing agents described in the above-mentioned RD's are also useful.

Examples of the antioxidants used for this purpose include chroman compounds, coumaran compounds, phenol compounds (for example, hindered phenols), hydroquinone derivatives, hindered amine derivatives, and spiroindan compounds. Compounds described in JP-A-61-159644 are also efficient.

Examples of the ultraviolet-absorbing agents include benzotriazole compounds (U.S. Pat. No. 3,533,794, etc.), 4-thiazolidone compounds (U.S. Pat. No. 3,352,681, etc.), benzophenone compounds (JP-A-46-2784, etc.) and, in addition, compounds described in JP-A-54-48535, JP-A-62-136641, JP-A-61-88256, etc. Further, ultraviolet-absorbing polymers described in JP-A-62-260152 are also efficient.

The metal complexes include compounds described in U.S. Pat. Nos. 4,241,155, 4,245,018 (column 3 to 36) and 4,254,195 (column 3 to 8), JP-A-62-174741, JP-A-61-88256 (pp. 27–29), JP-A-63-199248, JP-A-1-75568, JP-A-1-74272, etc.

The discoloration preventives for dyes transferred to the image-fixing element may be incorporated into the image-fixing element beforehand, or may be supplied from the outside, that is, from the light-sensitive element or by the use of transfer solvents described later, to the image-fixing element.

The above-mentioned antioxidants, ultraviolet-absorbing agents, and metal complexes may be employed incombination with one another.

Fluorescent brightening agents may be used for the light-sensitive element or the image-fixing element. It is particularly preferred that the fluorescent brightening agents may be incorporated into the image-fixing element beforehand, or may be supplied from the outside, that is, from the light-sensitive element or by the use of the transfer solvents. Examples of the fluorescent brightening agents include those described in *The Chemistry of Synthetic Dyes*, (Vol. V, Chapter 8), edited by K. Veenkataraman, JP-A-61-143752, etc., and more concretely, include stilbene compounds, coumarin compounds, biphenyl compounds, benzoxazolyl compounds, naphthalimide compounds, pyrazoline compounds, and carbostyril compounds.

The fluorescent brightening agents can be used in combination with the discoloration preventives or the ultraviolet-absorbing agents. Examples of the discoloration agents, the discoloration preventives and the fluorescent brightening agents are described in JP-A-62-215272 (pp. 125–137) and JP-A-1-161236 (pp. 17–43).

Hardening agents used for the constituent layers of the light-sensitive element and the image-fixing element include those described in the above-mentioned RD's, U.S. Pat. Nos. 4,678,739 (column 41) and 4,791,042, JP-A-59-116655, JP-A-62-245261, JP-A-61-18942, JP-A-4-218044, etc., and more concretely, include aldehyde-type hardening agents (formaldehyde, etc.), aziridine-type hardening agents, epoxy-type hardening agents, vinylsulfone-type hardening agents (N,N'-ethylene-bis (vinylsulfonylacetamido)ethane, etc.), N-methylol-type hardening agents (dimethylolurea, etc.), and polymeric hardening agents (compounds described in JP-A-62-234157, etc.).

These hardening agents are used in an amount of 0.001 g to 1 g, preferably 0.005 g to 0.5 g per 1 g of gelatin applied. They may be incorporated into any of the constituent layers of the light-sensitive element and the image-fixing element, or may be dividedly added to the two or more layers.

Various antifogging agents, photographic stabilizers, and their precursors can be used for the constituent layers of the light-sensitive element and the image-fixing element. Examples thereof include compounds described in the above-mentioned RD's, U.S. Pat. Nos. 5,089,378, 4,500,627 and 4,614,702, JP-A-64-13546 (pp. 7–9, pp. 57–71 and pp. 81–97), U.S. Pat. Nos. 4,775,610, 4,626,500 and 4,983,494, JP-A-62-174747, JP-A-62-239148, JP-A-63-264747, JP-A-1-150135, JP-A-2-110557, JP-A-2-178650, RD 17643 (1978, pp. 24–25), etc.

The content of these compounds is preferably from $5\times10^{-6}$ to $1\times10^{-1}$ mole, and more preferably from $1\times10^{-5}$ to $1\times10^{-2}$ mole per 1 mole of silver.

Various surfactants can be used for the constituent layers of the light-sensitive element and image-fixing element as coating aid, or for improvement in separation, improvement in slip properties, prevention of static electrification, promotion of development. Examples of the surfactants are described in the above-mentioned RD's, JP-A-62-173463, JP-A-62-183457, etc.

Organic fluorine compounds may be incorporated into the constituent layers of the light-sensitive element and image-fixing element for improvement in slip properties, prevention of static electrification, or improvement in separation. Typical examples of the organic fluorine compounds include fluorine surfactants described in JP-B-57-9053 (column 8 to 17), JP-A-61-20944, JP-A-62-135826, etc., and hydrophobic fluorine compounds such as oily fluorine compounds (for example, fluorocarbon oils.) and solid fluorine compound resins (for example, tetrafluoroethylene resins).

Matting agents can be used for the light-sensitive element and the image-fixing element for preventing blocking, improving slip properties and providing non-glossy surfaces. In addition to compounds such as silicon dioxide, polyolefins and polymethacrylates as described in JP-A-61-88256 (p. 29), the matting agents include compounds such as benzoguanamine resin beads, polycarbonate resin beads, AS resin beads as described in JP-A-63-274944 and JP-A-63-274952. Besides, compounds described in the above-mentioned RD's can also be used. These matting agents can be incorporated not only into a top layer (protective layer) but also into lower layers, as needed.

In addition, heat solvents, antifoaming agents, antimicrobial and antifungal agents, and colloidal silica may be incorporated into the constituent layers of the photosensitive element and image-fixing element. Examples of these additives are described in JP-A-61-88256 (pp. 26–32), JP-A-3-11338, JP-B-2-51496, etc.

In the present invention, image forming accelerators can be used for the light-sensitive element and/or the image-fixing element. The image forming accelerators have functions of promoting a redox reaction between silver salt oxidizing agents and reducing agents; of promoting reactions such as formation of dyes from dye-providing substances, cleavage of dyes, and release of diffusive dyes; and of promoting transfer of dyes from the light-sensitive layer to the dye fixing layer. In view of physicochemical functions, the image forming accelerators are classified into bases or base precursors, nucleophilic compounds, high boiling organic solvents (oils), heat solvents, surfactants, and compounds interacting with silver or silver ion. However, the group of these substances have composite functions, in general, and usually have some of the above-mentioned promoting effects at the same time, respectively. Details of these are described in U.S. Pat. No. 4,678,739 (column 38 to 40).

The base precursors include salts of bases with organic acids which is decarboxylated with the aid of heat and compounds which release amines by intramolecular nucleophilic displacement reaction, Lossen rearrangement, or Beckmann rearrangement. Examples thereof are described in U.S. Pat. Nos. 4,514,493 and 4,657,848, etc.

In a system where the heat development and the transfer of dyes are simultaneously carried out in the presence of a small amount of water, it is preferred that the bases and/or base precursors are incorporated into the image-fixing element to improve the storability of the light-sensitive element.

In addition, combinations of slightly soluble metal compounds described in published European patent application 210,666 and U.S. Pat. No. 4,740,445 with compounds capable of forming complexes (referred to as "complexing agents") with the metallic ions constituting these slightly soluble metal complexes, and compounds from which bases are produced by electrolysis as described in JP-A-61-232451 can also be employed as the base precursors. The former is particularly effective. It is advantageous that the slightly soluble metal compounds and complexing agents are separately added to the light-sensitive element and the image-fixing element as described in the above-mentioned specification.

In the present invention, various development inhibitors can be employed for the light-sensitive element and/or the image-fixing element in order to constantly acquire definite images against changes in processing temperature and processing time for development.

The development inhibitors herein mean compounds which can decrease the base concentration in film by rapidly neutralizing bases or reacting with bases after completing proper development or compounds which inhibit development by interacting with silver or silver ion. Examples thereof include acid precursors releasing acids by heating, electrophilic compounds which are substituted by coexisting bases with the aid of heat, and in addition, nitrogen-containing heterocyclic compounds and mercapto compounds and the precursors thereof. The inhibitors are described in JP-A-62-253159 (pp. 31–32) in great detail.

Methods for recording images on the light-sensitive element by exposure include a method of directly taking landscape photographs or portraits by the use of cameras; a method of performing exposure through reversal films or negative films by the use of printers or enlargers; a method of performing scanning exposure of originals through a slit by the use of current to light transference devices of copying equipment; a method of performing scanning exposure of image data via electric signal by emitting light from light emission diodes or various lasers (laser diode, gas laser, etc.) as described in JP-A-2-129625, JP-A-5-176114, JP-A-5-199872, JP-A-6-127021, etc.; a method of performing exposure of image data directly or via an optical system after output on image display devices such as a CRT, a liquid crystal display, an electroluminescence display, a plasma display; and so forth.

Light sources and methods of exposure including natural light, tungsten filament lamps, light emission diodes, laser light sources, and CRT light sources as described in U.S. Pat. No. 4,500,626 (column 56), JP-A-2-53378, and JP-A-2-54672 can be employed for recording images on the light-sensitive element.

Further, image exposure can also be carried out by the use of a wave-changing element in which nonlinear optical materials are combined with coherent light sources such as laser rays. The nonlinear optical materials herein mean materials capable of developing nonlinearity between polarization and an electric field which emerges by giving a strong photoelectric field such as laser rays. The nonlinear optical materials used preferably include inorganic compounds such as lithium niobate, potassium dihydrogenphosphate (KDP), lithium iodate, and $BaB_2O_4$, urea derivatives, nitroaniline derivatives, nitropyridine-N-oxide derivatives such as 3-methyl-4-nitropyridine-N-oxide (POM), and compounds described in JP-A-61-53462 and JP-A-62-210432. Known forms of the wave changing element are a single crystal light wave guide-type and a fiber-type, any of which is useful.

The image data usable herein include an image signal obtained from video cameras or electric still cameras, a television signal represented by Nippon Television Signal Criteria (NTSC), an image signal obtained by dividing an original into a large number of pixels by the use of a scanner, and an image signal prepared by computers represented by CG and CAD.

The light-sensitive element and/or the image-fixing element of the present invention may be in a form containing an electrically-conductive heating layer as a heating means for the heat development and the diffusion transfer of dyes. In this case, a heating element described in JP-A-61-145544, etc. can be utilized.

In the heat development step, the heating temperature is from about 50° C. to 250° C., and particularly efficiently from about 60° C. to 180° C. The diffusive transfer of dyes may be simultaneously performed with the heat development, or may be carried out after finishing the heat development. In the latter case, the diffusive transfer can be performed at a temperature ranging from the heating temperature in the heat development step to room temperature, and particularly preferably ranging from 50° C. to 10° C. lower temperatures than the heating temperature in the heat development step.

Although the transfer of dyes can also be carried out by only heating, a solvent may be employed to promote the transfer. Further, it also is efficient to perform the development and the transfer, simultaneously or successively, by heating in the presence of a small amount of a solvent (particularly preferably, water) as described in U.S. Pat. Nos. 4,704,345 and 4,740,445, JP-A-61-238056, etc. In this system, the heating temperature is preferably from 50° C. to the boiling point of the solvent. For example, when the solvent is water, the heating temperature is preferably from 50° C. to 100° C.

Examples of the solvents used for the promotion of development and/or the diffusive transfer of dyes include water, basic aqueous solutions containing inorganic alkali metal salts or organic bases (The bases described in the section of the image forming accelerators are used), low boiling point solvents, and mixtures of the low boiling point solvents and water or the above-mentioned basic aqueous solutions. These solvents can contain surfactants, antifogging agents, compounds forming complexes with slightly soluble metal salts, antifungal agents, or antimicrobial agents.

Water is preferably employed as the solvent used in the heat development step and the diffusive transfer step. Any water used in general, including distilled water, tap water, well water, and mineral water, can be employed for this purpose. In the heat development device to process the light-sensitive element and the image-fixing element of the present invention, water may be used up or cyclic water may be repeatedly used. In the latter case, water containing components dissolving out from the materials will be employed. Devices and water described in JP-A-63-144354, JPA-63-144355, JP-A-62-38460, JP-A-3-210555, etc. can also be employed.

These solvents can be supplied to either or both of the light-sensitive element and the image-fixing element. The amount of the solvents may be less than weight corresponding to the maximum swelling volume of total films coated.

Methods for supplying water as described, for example, in JP-A-62-253159 (p. 5), JP-A-63-85544, etc. are preferably employed. Microencapsulated solvents or hydrates can be incorporated into either or both of the light-sensitive element and the image-fixing element beforehand.

The amount of the solvent is approximately from 4 to 40 $cc/m^2$.

The temperature of water supplied ranges from 30° C. to 60° C. as described in the above-mentioned JP-A-63-85544, etc. Maintaining the temperature at 45° C. or higher is efficient to prevent various bacteria propagation in water.

Hydrophilic heat solvents which are solid at ordinary temperature and melt at a higher temperature can be incorporated into the light-sensitive element and/or the image-fixing element to promote the dye transfer. Layers into which the solvents are incorporated may be any of light-sensitive silver halide emulsion layers, an interlayer, a protective layer, and a dye fixing layer, and preferably the dye fixing layer and/or an adjacent layer thereof.

Examples of the hydrophilic heat solvents include ureas, pyridines, amides, sulfonamides, imides, alcohols, oximes, and other heterocylces.

Heating in the development step and/or the transfer step is carried out by contacting with a heated block or plate, by contacting with a heating plate, a hot press, a heating roller, a heating drum, a halogen lamp heater, or infrared or far infrared lamp heater, or by passing through an atmosphere of high temperature.

A method described in JP-A-62-253159 and JP-A-61-147244 (p. 27) can be applied for superposing the light-sensitive element on the dye fixing element. Generally, thelight-sensitive element and the dye fixing element areattached to each other at a pressure of from about 0.1 toabout 5 kg/cm$^2$.

Any of various heat development devices can be employed for processing the photographic elements of the present invention. For example, devices described in JP-A-59-75247, JP-A-59-177547, JP-A-59-181353, JP-A-60-18951, JP-A-U-62-25944 (The term "JP-A-U" as used herein means an "unexamined published Japanese utility model application"),JP-A-6-130509, JP-A-6-95338, JP-A-6-95267, etc. are preferably employed. Further, commercial available devices, Pictrostat 100, Pictrostat 300, Pictrography 3000, and Pictrography 2000 which are manufactured by Fuji Photo Film Co., Ltd. can be employed.

The present invention is illustrated by examples below. However, the present invention is not limited by these examples.

EXAMPLES 1

A mixture of 90 parts by weight of polyethylene terephthalate (PET) pellets and 10 parts by weight of polypropylene was melted and extruded from an extruder at 295° C. The resulting melt in a form of amorphous sheet was cooled and solidified on a cooling roll maintained at 35° C. to prepare an amorphous sheet having a thickness of 850 $\mu$m.

The amorphous sheet was stretched 3 times in the lengthwise direction at 130° C. and 3.5 times in the crosswise direction at 145° C., and then was subjected to heat-fix at 235° C. under 5% relaxation to prepare a support of the present invention, which had a thickness of 80 $\mu$m and an apparent specific gravity of 0.95.

On the other hand, two sheets of polyethylene having a thickness of 30 $\mu$m were laminated to the both surfaces of a sheet of paper having a thickness of 70 $\mu$m to prepare resin-coated paper as comparative support (1).

Further, two sheets of polyethylene having a thickness of 15 $\mu$m were laminated to the both surfaces of a sheet of paper having a thickness of 50 $\mu$m to prepare resin-coated paper as comparative support (2).

EXAMPLE 2

The constituent layers of light-sensitive material 101 of an example of JP-A-8-62808 were provided on the respective supports obtained in Example 1 according to the procedure described in said specification. The light-sensitive material having the support of the present invention was made photo-sensitive element A-1, the light-sensitive material having comparative support (1) was made light-sensitive element A-2, and the light-sensitive material having comparative support (2) was made light-sensitive element A-3.

On the other hand, image-accepting material 201 of the example of JP-A-8-62808 was prepared according to the procedure described in said specification. This was made image-fixing element R-O.

Processing was performed on Pictrostat 300 manufactured by Fuji Photo Film Co., Ltd. by use of light-sensitive elements A-1, A-2 and A-3 and image-fixing element R-O.

The respective light-sensitive elements were subjected to scanning exposure of a negative through the slit, and dipped in water maintained at 40° C. for 2.5 seconds, squeezed between rollers, and immediately thereafter, superposed on the image-fixing elements so as to be in contact with the emulsion sides of the light-sensitive elements. The elements superposed were heated for 30 seconds on a heating drum adjusted so that the temperature of the emulsion sides having absorbed water became 80° C., and the image-fixing elements was stripped from the light-sensitive elements to obtain color images corresponding to the negative, respectively.

The results of observation of the images revealed that the image obtained from light-sensitive element A-1 having the support of the present invention did not develop processing unevenness and white spot at all, the images from light-sensitive element A-2 developed slight processing unevenness and white spot, and the image from light-sensitive element A-3 developed prominent processing unevenness and white spots over the entire image. These facts show that the use of the support of the present invention leads to an improvement in processing unevenness and white spot, and particularly, the effect of the present invention is apparent in use of a thin support.

EXAMPLE 3

The constituent layers of image-accepting material 101 of an example of JP-A-8-87096 were provided on the respective supports obtained in Example 1 according to the procedure described in said specification. The image-accepting material having the support of the present invention was made image-fixing element R-1, the image-accepting material containing comparative support (1) was made image-fixing element R-2, and the image-accepting material containing comparative support (2) was made image-fixing element R-3.

On the other hand, light-sensitive material 101 of the example of JP-A-8-87096 was prepared according to the procedure described therein. This was made light-sensitive element B-1.

Processing was carried out on Pictrostat 300 manufactured by Fuji photo Film Co., Ltd. by use of image-fixing elements R-1, R-2 and R-3 and light-sensitive element B-1.

Light-sensitive elements B-1 were subjected to scanning exposure of an original (a test chart having yellow, magenta, and cyan-grey wedges whose respective densities continuously change) through the slit, dipped in water maintained at 40° C. for 2.5 seconds, squeezed between rollers, and immediately thereafter, superposed on the respective image-fixing elements so as to be in contact with the emulsion sides of the light-sensitive elements. The elements superposed were then heated for 17 seconds on a heating drum adjusted so that the temperature of the emulsion sides having absorbed water became 80° C., and the image-fixing agents were stripped from the light-sensitive elements to obtain color images corresponding to the original, respectively.

The result of observation of the images revealed that the image on fixing element R-1 having the support of the present invention did not develop processing unevenness and white spot at all, the image on image-fixing element R-2 developed slight processing unevenness and white spot, and the image on image-fixing element R-3 developed prominent processing unevenness and white spots over the entire image. These facts show that the use of the support of the present invention leads to an improvement in processing unevenness and white spot, and particularly, the effect of the present invention is apparent in use of thin weight support.

EXAMPLE 4

The constituent layers of photothermographic material 100 of the example of JP-A-7-261354 were provided on the respective supports obtained in Example 1 according to the procedure described in said specification. The light-sensitive material having the support of the present invention was made light-sensitive element C-1, the light-sensitive material having comparative support (1) was made light-sensitive element C-2, and the light-sensitive material having comparative support (2) was made light-sensitive element C-3.

Processing was performed on a digital color printer, Pictrography 3000 manufactured by Fuji Photo Film Co., Ltd. by use of light-sensitive elements C-1, C-2 and C-3 and image-fixing element R-O.

The respective light-sensitive element were subjected to laser exposure of digital image data, dipped in water maintained at 40° C. for 2.5 seconds, squeezed between rollers, and immediately thereafter, superposed on the image-fixing elements so as to be in contact with the emulsion sides of the light-sensitive elements. The elements superposed were heated for 30 seconds on a heating drum adjusted so that the temperature of the emulsion sides having absorbed water became 80° C., and the image-fixing elements were stripped from the light-sensitive elements to obtain color images corresponding to the digital image data, respectively.

The result of observation of the images revealed that the image obtained from light-sensitive element C-1 having the support of the present invention did not develop processing unevenness and white spot at all, the image obtained from light-sensitive element C-2 developed slight processing unevenness and white spot, and the image obtained from light-sensitive element C-3 developed prominent processing unevenness and white spots over the entire image.

These facts show that the use of the support of the present invention leads to an improvement in processing unevenness and white spot, and particularly, the effect of the present invention is apparent in use of thin weight support.

EXAMPLE 5

Processing was carried out on the heat development processor described in JP-8-15840 by use of image-fixing elements R-1, R-2 and R-3 prepared in Example 3 and light-sensitive element B-1.

That is, the light-sensitive elements were subjected to scanning exposure of an original (a test chart having yellow, magenta and cyan-grey wedges whose densities continuously change) through the slit, coated with 11 cc of water per square meter of the exposed light-sensitive elements, and immediately thereafter, superposed on the respective image-fixing elements so as to be in contact with the emulsion sides of the light-sensitive elements. The elements superposed were heated for 17 seconds on a heating plate adjusted so that the temperature of the emulsion sides having absorbed water became 80° C., and the image-fixing elements was stripped from the light-sensitive elements to obtain clear color images corresponding to the original, respectively.

The result of observation of the images revealed that the image on image-fixing element R-1 having the support of the present invention did not develop processing unevenness and white spot at all, the image on image-fixing element R-2 developed slight processing unevenness and white spot, and the image on image-fixing element R-3 developed prominent processing unevenness and white spots over the entire image. These facts show that use of the support of the present invention leads to an improvement in processing unevenness and white spot, and particularly, the effect of the present invention is apparent in use of thin weight support.

Use of the support of the present invention makes it possible to prepare image-forming materials improved in image faults of developing processing unevenness and white spot after heat development processing.

While the invention has been described in detail and with reference to specific embodiments thereof, it will be apparent to one skilled in the art that various changes and modifications can be made therein without departing from the spirit and scope thereof.

What is claimed is:

1. A diffusive transfer-type photothermographic material which comprises (i) a light-sensitive element comprising a light-sensitive silver halide and a binder provided on a first support and (ii) an image-fixing element provided on a second support, wherein said light-sensitive element and said image-fixing element are capable of forming an image by being attached to each other with a small amount of solvent under heat in the presence of a base, a base precursor or a mixture thereof, after or simultaneous imagewise exposure of said light-sensitive element, wherein at least one of the first support and the second support is a film which comprises a stretched and heat-fixed melt comprising a polyester and a polyolefin having a melting temperature lower than that of the polyester.

2. The diffusive transfer-type photothermographic material as claimed in claim 1, wherein said melt further contains an elastic polymer.

3. The diffusive transfer-type photothermographic material as claimed in claim 1, wherein said polyester is polyethylene terephthalate and said polyolefin is polypropylene.

4. The diffusive transfer-type photothermographic material as claimed in claim 1, wherein said support has an apparent specific gravity of 0.9 to 1.3.

5. The diffusive transfer-type photothermographic material as claimed in claim 1, wherein said melt further comprising at least one member selected from the group consisting of titanium oxide, barium sulfate and calcium carbonate.

* * * * *